US008899576B2

(12) United States Patent
Doshida

(10) Patent No.: US 8,899,576 B2
(45) Date of Patent: Dec. 2, 2014

(54) SHEET FEEDER AND IMAGE FORMING APPARATUS

(71) Applicant: Konica Minolta, Inc., Tokyo (JP)

(72) Inventor: Yuki Doshida, Toyokawa (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 14/163,586

(22) Filed: Jan. 24, 2014

(65) Prior Publication Data

US 2014/0217667 A1 Aug. 7, 2014

(51) Int. Cl.
*B65H 1/04* (2006.01)
*B65H 1/22* (2006.01)

(52) U.S. Cl.
CPC ..... *B65H 1/04* (2013.01)
USPC ..... 271/162; 271/164; 271/145

(58) Field of Classification Search
USPC ..... 271/145, 162, 164
See application file for complete search history.

(56) References Cited

U.S. PATENT DOCUMENTS 5,501,444 A * 3/1996 Yukimachi et al. ..... 271/127
7,926,805 B2 * 4/2011 Ueyama ..... 271/162
8,061,707 B2 * 11/2011 Sugishima ..... 271/164
2004/0051231 A1 * 3/2004 Amamoto et al. ..... 271/145
2009/0243206 A1 * 10/2009 Ueyama ..... 271/264
2010/0059928 A1 * 3/2010 Sugishima ..... 271/109
2012/0080839 A1 * 4/2012 Akimatsu ..... 271/253
2012/0205860 A1 * 8/2012 Yamaguchi ..... 271/157
2012/0306149 A1 * 12/2012 Sunohara ..... 271/226
2013/0049291 A1 * 2/2013 Ohtsuki ..... 271/162
2014/0145393 A1 * 5/2014 Naoi ..... 271/145

FOREIGN PATENT DOCUMENTS

JP 2009-203064 A 10/2009
JP 2012-020841 A 2/2012

* cited by examiner

*Primary Examiner* — Patrick Cicchino
(74) *Attorney, Agent, or Firm* — Lucas & Mercanti, LLP

(57) ABSTRACT

A sheet feeder includes a recording media storage device. The recording media storage device stores recording media and is attachable to and detachable from a main body of an image forming apparatus. The image forming apparatus includes a feeding mechanism to pick up and convey one of the recording media at a time. The lock member disables the recording media storage device to be detached. The overflow restriction member is disposed in the main body and changes between a restriction position closer to an uppermost part of the recording media and a withdrawal position farther from the uppermost part of the recording media. The position change mechanism is disposed in the main body and changes the overflow restriction member into the restriction position when the lock member changes into a free state in which the recording media storage device is attachable and detachable.

15 Claims, 9 Drawing Sheets

SHEET FEEDER AND IMAGE FORMING APPARATUS

CROSS-REFERENCE TO RELATED APPLICATIONS

The present application claims priority under 35 U.S.C. §119 to Japanese Patent Application No. 2013-18480, filed Feb. 1, 2013. The contents of this application are incorporated herein by reference in their entirety.

BACKGROUND OF THE INVENTION

1. Field of the Invention

The present invention relates to a sheet feeder and an image forming apparatus.

2. Discussion of the Background

As conventionally known, image forming apparatuses include a sheet feeder that stores stacked recording media used for image forming. The sheet feeder is removable from a main body of the image forming apparatus to be refilled with recording media to be stored. The image forming apparatus further includes a feeding mechanism in the main body that stores the sheet feeder. The feeding mechanism separates the recording media stacked in the sheet feeder into individual sheet and feeds the sheet. The feeding mechanism includes a pick-up roller, a sheet feed roller, and a separation member (such as a separation pad and a separation roller). The pick-up roller comes into contact with the uppermost surface of the recording media stacked on the sheet feeder, and picks up an upper part of the recording media. The sheet feed roller and the separation member separate the part of the recording media picked up by the pick-up roller into individual sheets.

With the image forming apparatus including the feeding mechanism in the main body, when the sheet feeder is pulled out of the image forming apparatus, the uppermost recording medium might get caught by the feeding mechanism. As a result, the recording medium might flow over the sheet feeder to fall within and remain in the main body (sheet might remain in the main body). When the sheet feeder is inserted to the main body with the sheet remaining in the main body, the remaining sheet not only is damaged but also causes paper jam. In an attempt to prevent the sheet remaining problem. Japanese Unexamined Patent Application Publication No. 2009-203064 discloses an image forming apparatus that includes a pressing mechanism in the main body. The pressing mechanism presses the uppermost recording medium in the sheet feeder from above as the sheet feeder is being pulled out.

Unfortunately, the pressing mechanism disclosed in Japanese Unexamined Patent Application Publication No. 2009-203064 has such a structure that makes the pressing mechanism operate in tandem to the operation of pulling out the sheet feeder. Specifically, the operation of pressing the uppermost recording medium in the sheet feeder proceeds in proportion to the amount of pulling of the sheet feeder. This causes a time lag between the starting of the pulling of the sheet feeder and the finishing of the pressing of the uppermost recording medium by the pressing mechanism. Thus, there still remains a possibility that the uppermost recording medium flows over the sheet feeder in the time lag, leaving room for improvement in terms of reliability of restriction of the remaining of a sheet.

The present invention has been made in view of the above-described circumstances.

SUMMARY OF THE INVENTION

According to one aspect of the present invention, a sheet feeder includes a recording media storage device, a lock member, an overflow restriction member, and a position change mechanism. The recording media storage device is configured to store recording media. The recording media storage device is attachable to and detachable from a main body of an image forming apparatus. The image forming apparatus includes a feeding mechanism configured to pick up and convey one of the recording media stored in the recording media storage device at a time. The lock member is configured to disable the recording media storage device to be detached. The overflow restriction member is disposed in the main body and is configured to change between a restriction position closer to an uppermost part of the recording media in the recording media storage device and a withdrawal position farther from the uppermost part of the recording media. The position change mechanism is disposed in the main body and is configured to change the overflow restriction member into the restriction position when the lock member changes into a free state in which the recording media storage device is attachable and detachable.

According to another aspect of the present invention, an image forming apparatus includes a recording media storage device, a feeding mechanism, a lock member, an overflow restriction member, and a position change mechanism. The recording media storage device is configured to store recording media. The feeding mechanism is configured to pick up and convey one of the recording media stored in the recording media storage device at a time. The lock member is configured to switch the recording media storage device between a state in which the recording media storage device is not detachable and a state in which the recording media storage device is attachable and detachable. The overflow restriction member is configured to change between a restriction position closer to an uppermost part of the recording media in the recording media storage device and a withdrawal position farther from the uppermost part of the recording media. The position change mechanism is configured to change the overflow restriction member into the restriction position when the lock member changes into a free state in which the recording media storage device is attachable and detachable.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 6A shows a locking state, FIG. 6B shows a free state, FIG. 6C shows a state in which a recording media storage device is pulled out, FIG. 6D shows a state in which insertion of the recording medium storage device starts, FIG. 6E shows a state of transition from the free state to the locking, and FIG. 6F shows a state of recurrence of the locking state;

FIG. 7A shows a relationship in the locking state, and FIG. 7B shows a relationship in the free state:

FIG. 13A shows a relationship in the locking state, and FIG. 13B shows a relationship in the free state.

DESCRIPTION OF THE EMBODIMENTS

Figure 3:
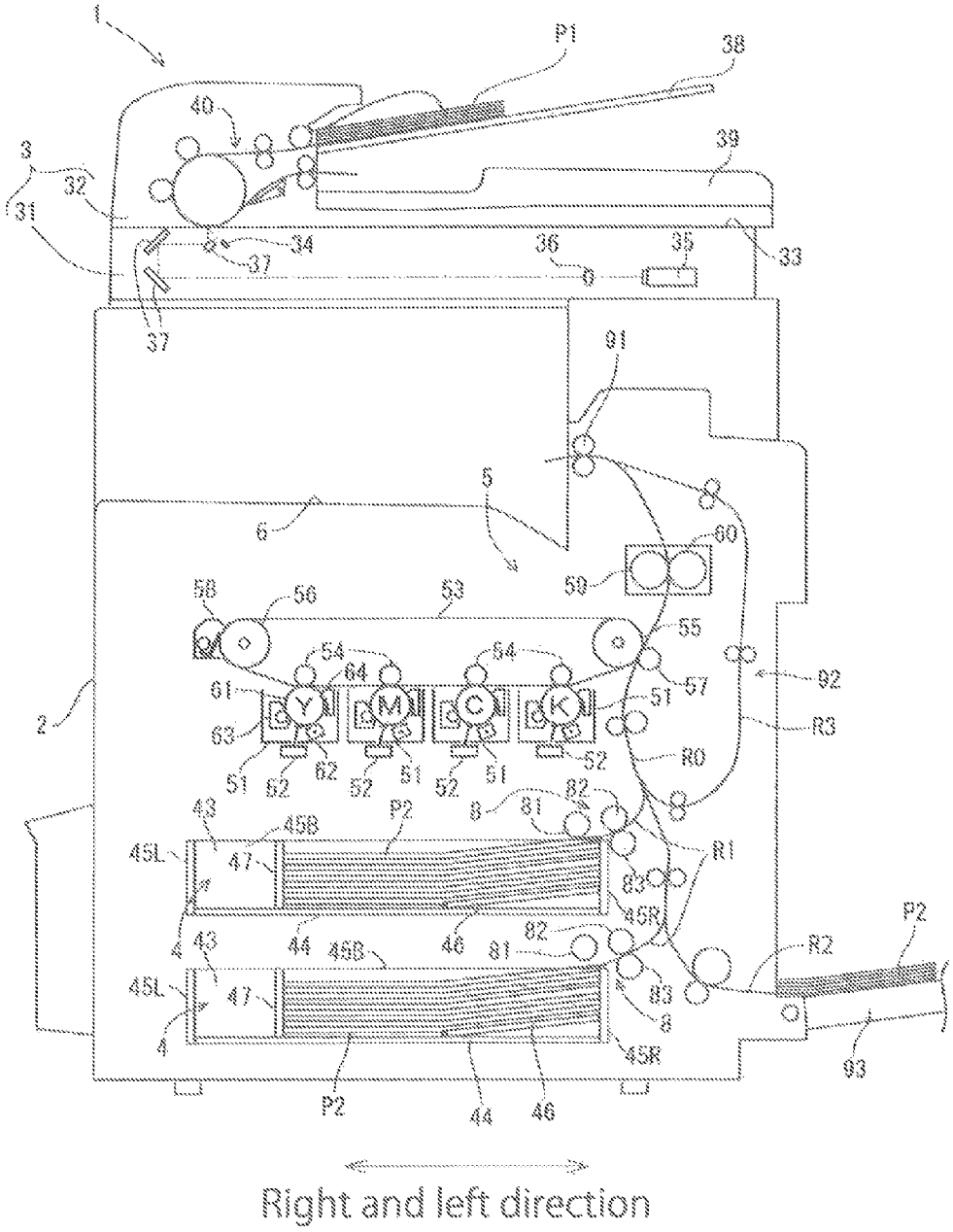
FIG. 3 is a schematic configuration diagram showing an internal configuration of the image forming apparatus.

An embodiment will now be described with reference to the accompanying drawings, wherein like reference numerals designate corresponding or identical elements throughout the various drawings. In the following description, terms indicating specific directions and positions (for example, "left and right" and "upper and lower") are used where necessary. In this respect, the direction perpendicular to the paper plane of FIG. 3 is defined as front view. The terms are used for the sake of description and will not limit the technical scope of the present invention.

<Overall Configuration of Image Forming Apparatus>

Figure 1:
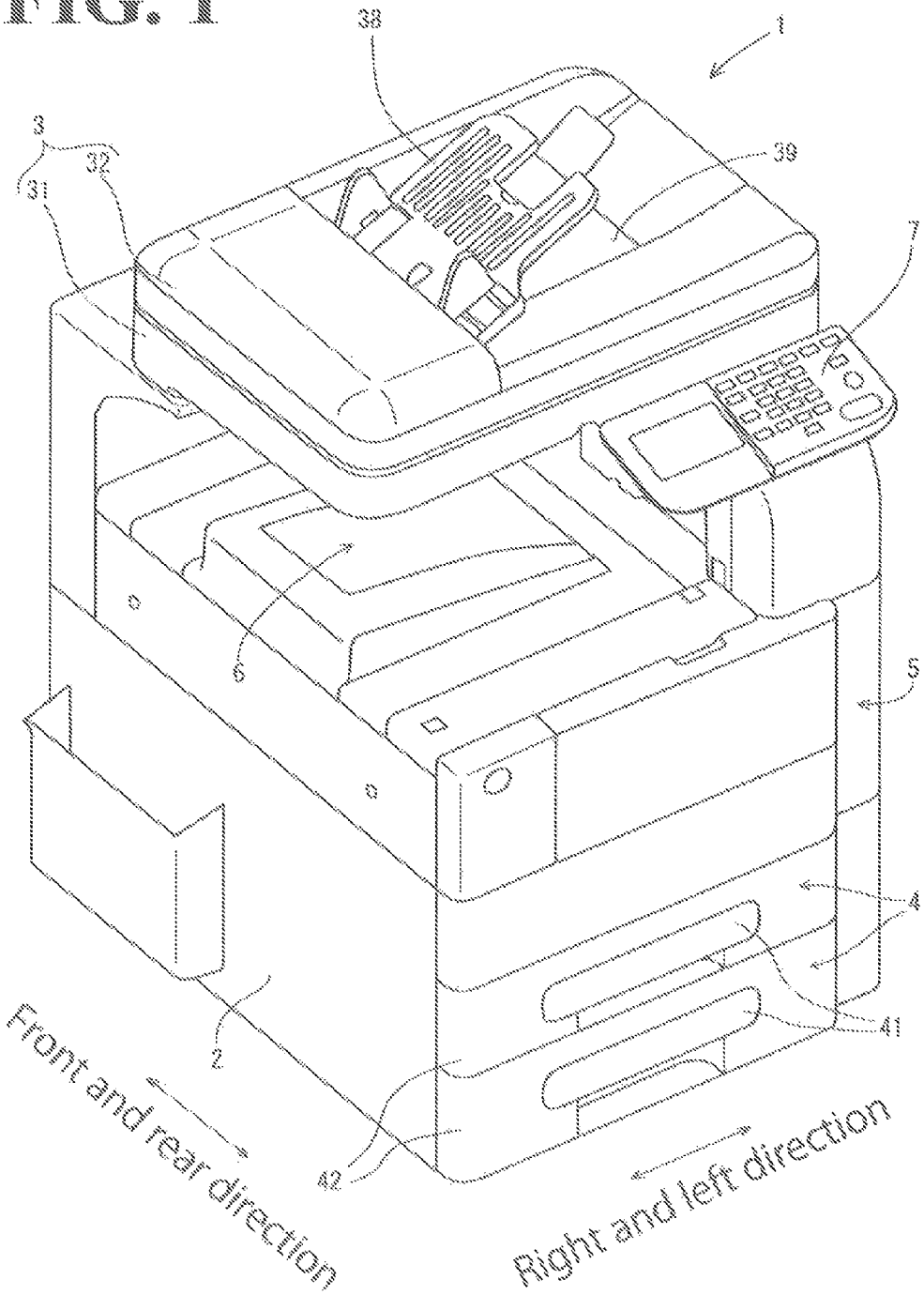
FIG. 1 is an outer perspective view of an image forming apparatus.
Figure 2:
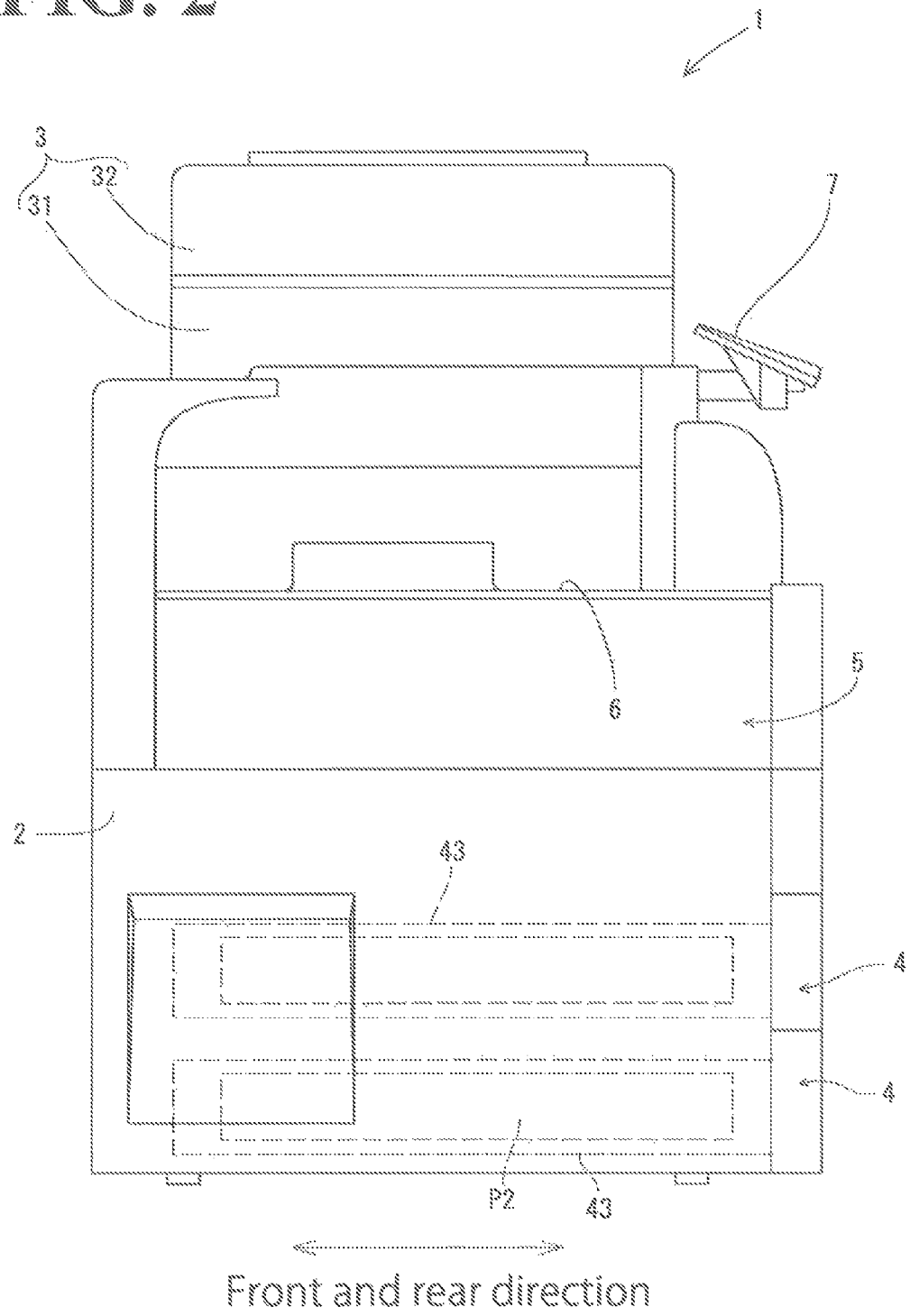
FIG. 2 is a right side view of the image forming apparatus.

An overall configuration of an image forming apparatus common to all the embodiments described below will be described by referring to the drawings. As shown in FIG. 1 and FIG. 2, an image forming apparatus 1 includes an image reader 3, a sheet feeder 4, an image forming device 5, a collection tray 6, and an operation panel 7. The image reader 3 reads an image on a document model P1. The sheet feeder 4 stores recording media P2, on which an image is to be formed. The image forming device 5 forms an image on the recording medium P2 fed from the sheet feeder 4. On the collection tray 6, the recording medium P2 on which the image has been formed in the image forming device 5 is discharged. The operation panel 7 receives an operation for the image forming apparatus 1. The image reader 3 is disposed in an upper portion of a main body 2 of the image forming apparatus 1, and the image forming device 5 is disposed below the image reader 3.

The collection tray 6 is disposed above the image forming device 5 in the main body 2 to receive the discharged recording medium P2 on which an image has been formed at the image forming device 5. The removable sheet feeder 4 is disposed below the image forming device 5 in the main body 2 in an attachable and detachable manner. Thus, in this configuration, the recording medium P2 stored in the sheet feeder 4 is fed into the main body 2, and then is conveyed upward. An image is formed on the recording medium P2 in the image forming device 5, which is disposed above the sheet feeder 4. Then, the recording medium P2 is discharged onto the collection tray 6 disposed in the space (recessed space) defined between the image reader 3 and the image forming device 5. This will be described later.

The image reader 3, which is disposed above the main body 2, includes a scanner 31 and an auto document feeder (ADF) 32. The scanner 31 reads the image on the document model P1. The ADF 32 is disposed above the scanner 31 and conveys one of the document models P1 at a time to the scanner 31. The operation panel 7 is disposed on a front side (forward side) of the main body 2. A user operates the keys by referring to the display screen and the like on the operation panel 7 when the user executes various kinds of setting of a function selected from the various functions of the image forming apparatus 1 and instructs the image forming apparatus 1 to execute processing.

The sheet feeder 4 includes a front cover 42 and a recording media storage device 43. The front cover 42 is provided with a handle 41 held by the user to insert or pull the sheet feeder 4 into or out of the main body 2. The recording media storage device 43 stores the stacked recording media P2. The sheet feeder 4 slides in front and rear directions to be inserted into and pulled out of the main body 2. When the sheet feeder 4 is inserted into the main body 2, the recording media storage device 43 is stored in the main body 2, and the front cover 42 serves as a part of the front surface of the main body 2. A feeding mechanism 8 (see FIG. 3), described later, is disposed on the right side of the recording media storage device 43 of the sheet feeder 4. The feeding mechanism 8 picks up the recording medium P2 stored in the recording media storage device 43 and conveys the recording medium P2 to the image forming device 5.

Next, an internal structure of the main body 2 will be described by referring to FIG. 3. The scanner 31 of the image reader 3 above the main body 2 includes a platen 33, a light source device 34, an image sensor 35, an imaging lens 36, and a mirror group 37. The platen 33 has a platen glass (not shown) on an upper surface side. The light source device 34 radiates light onto the document model P1. The image sensor 35 performs photoelectric conversion of reflected light from the document model P1 into image data. The imaging lens 36 images the reflected light on the image sensor 35. The mirror group 37 sequentially reflects the reflected light from the document model P1 so that the reflected light is incident on the imaging lens 36. The light source device 34, the image sensor 35, the imaging lens 36, and the mirror group 37 are disposed in the platen 33. The light source device 34 and the mirror group 37 are movable in left and right directions with respect to the platen 33.

On the upper surface side of the scanner 31, the ADF 32 is openably disposed on the platen 33. The ADF 32 has a function of holding the document model P1 on the platen glass (not shown) by being laid on the document model P1 on the platen glass (not shown) of the platen 33. The ADF 32 includes a document placement tray 38 and a document collection tray 39.

When the image reader 3 with the above-described configuration reads the document model P1 on the platen glass (not shown) of the platen 33, the document model P1 is irradiated with light from the light source device 34 moving rightward (in a sub scanning direction). The reflected light from the document model P1 is sequentially reflected by the mirror group 37 moving in the same direction as the light source device 34, that is, rightward. Thus, the reflected light is incident on the imaging lens 36 and is imaged on the image sensor 35. The image sensor 35 performs photoelectric conversion for each pixel in accordance with the intensity of the incident light to generate an image signal (RGB signal) corresponding to the image on the document model P1.

When the image reader 3 reads the document model P1 placed on the document placement tray 38, the document model P1 is conveyed to a reading position by a document conveyance mechanism 40 including a plurality of rollers and other elements. Here, the light source device 34 and the mirror group 37 of the scanner 31 are secured at predetermined positions in the platen 33. Thus, the light is radiated onto a portion of the document model P1 at the reading position, and the reflected light is imaged on the image sensor 35 through the mirror group 37 and the imaging lens 36 in the scanner 31. The image sensor 35 converts the reflected light into an image signal (RGB signal) corresponding to the image on the document model P1. Then, the document model P1 is discharged onto the document collection tray 39.

The image forming device 5 includes, as a transfer unit that transfers a toner image onto the recording medium P2, image forming devices 51, exposure devices 52, an intermediate transfer belt 53, primary transfer rollers 54, a drive roller 55, a driven roller 56, a secondary transfer roller 57, and a cleaner 58. The image forming devices 51 respectively generate yellow (Y), magenta (M), cyan (C), and key tone (K) toner images. The exposure devices 52 are respectively disposed below the image forming devices 51. The intermediate transfer belt 53 comes into contact with the image forming devices 51 of the respective colors arranged in a horizontal direction. Thus, the toner images of the respective colors are transferred onto the intermediate transfer belt 53. The primary transfer rollers 54 are disposed above and in opposition to the respective image forming devices 51 in such a manner that the primary transfer rollers 54 and the image forming devices 51 sandwich the intermediate transfer belt 53. The drive roller 55 drivingly rotates the intermediate transfer belt 53. The driven roller 56 is drivingly rotated when the rotation of the drive roller 55 is transmitted to the driven roller 56 through the intermediate transfer belt 53. The secondary transfer roller 57 is disposed in opposition to the driving roller 55 with the intermediate transfer belt 53 interposed between the secondary transfer roller 57 and the driving roller 55. The cleaner 58 is disposed in opposition to the driven roller 56 with the intermediate transfer belt 53 interposed between the cleaner 58 and the driven roller 56.

Each of the image forming devices 51 includes a photoreceptor drum 61, a charger 62, a developer 63, and a cleaner 64. The photoreceptor drum 61 comes into contact with an outer peripheral surface of the intermediate transfer belt 53. The charger 62 charges an outer peripheral surface of the photoreceptor drum 61 by corona charging. The developer 63 causes the stirred and charged toner to be attached onto the outer peripheral surface of the photoreceptor drum 61. The cleaner 64 removes the toner remaining on the outer peripheral surface of the photoreceptor drum 61 after the toner image has been transferred onto the intermediate transfer belt 53. The photoreceptor drum 61 is disposed in opposition to the primary transfer roller 54 with the intermediate transfer belt 53 interposed between the photoreceptor drum 61 and the primary transfer roller 54, and rotates in the clockwise direction of FIG. 3. Around the photoreceptor drum 61, the primary transfer roller 54, the cleaner 64, the charger 62, the exposure unit 52, and the developer 63 are arranged in this order in the rotational direction of the photoreceptor drum 61.

The intermediate transfer belt 53 is a conductive endless belt, for example. The intermediate transfer belt 53 is tightly wound across the driving roller 55 and the driven roller 56. Thus, the intermediate transfer belt 53 is drivingly rotated in the counter clockwise direction in FIG. 3 by the rotation of the driving roller 55. Around the intermediate transfer belt 53, the secondary transfer roller 57, the cleaner 58, and the image forming devices 51 of YMCK colors are arranged in this order in the rotational direction of the intermediate transfer belt 53.

The image forming device 5 includes a heating roller 59 and a pressure roller 60 as a fixing unit that fixes the toner image transferred onto the recording medium P2. The heating roller 59 includes a halogen lamp or a similar element that performs heating so that the toner image on the recording medium P2 is fixed. The pressure roller 60 holds and presses the recording medium P2 together with the heating roller 59. A surface of the heating roller 59 may be heated by producing an eddy current on the surface by electromagnetic induction.

The recording media storage device 43 of the sheet feeder 4 has a shape of a box formed by a bottom plate 44 and surrounding front, back, left, and right side plates 45F, 45B, 45L, and 45R. The recording media P2 are placed on the bottom plate 44 with their right sides in contact with the inner wall of the right side plate 45R. An elevation plate 46 is disposed at a portion of an upper surface of the bottom plate 44 on the side of the right side plate 45R. A side of the elevation plate 46 on the side of the right side plate 45R vertically turns to elevate the recording medium P2. A compression spring 48 to bias the elevation plate 46 upward is disposed between the bottom plate 44 and the elevation plate 46 (see FIG. 5). The elastic biasing force of the compression spring 48 on the lower surface of the elevation plate 46 and the weight of the recording media P2 on the elevation plate 46 work together to put the right side of the topmost one of the recording media P2 on the elevation plate 46 at an optimum position to be picked up by the feeding mechanism 8.

A recording medium regulation member 47 protrudes from a portion of the bottom plate 44 on the side of the left side plate 45L. The recording medium regulation member 47 is able to slide leftward and rightward. The recording medium regulating member 47 regulates the left side position of the recording medium P2 so that the right side of the recording medium P2 comes into contact with the inner wall of the right side plate 45R. A pair of sheet width regulating plates 49 as side regulation members for regulating front and rear width direction positions of the unpicked recording medium P2 stand on the bottom plate 44 (see FIG. 4 and FIG. 5). The pair of sheet width regulating plates 49 hold the unpicked recording media P2 across its width so as to align the recording media P with the center reference. The pair of sheet width regulating plates 49 simultaneously move close to or away from each other in the front and rear width directions. In the recording media storage device 43, the pair of sheet width regulation plates 49 hold both sides of the recording medium P2 in the front and rear width direction. This ensures that recording media P2 of any standard are set at the center reference in the recording media storage device 43.

The feeding mechanism 8 includes a pick-up roller 81 and a pair of separating rollers including a sheet feed roller 82 and a separation roller 83. The pick-up roller 81 picks up the uppermost part of the recording media P2 in the recording media storage device 43. The pair of separating rollers separate the picked part of recording media P2 into individual sheets. A sheet of recording media P from the recording media storage device 43 is sent to the main conveyance path R0 through a sheet feed path R1 starting from the uppermost sheet by the driving rotation of the sheet feed roller 82 and the separation roller 83. The main conveyance path R0 serves as a main path through which the recording media P2 are subjected to an image forming (printing) process. The sheet feed path R1 is provided for each sheet feed device 4, and each sheet feed path R1 joins the main conveyance path R0.

A manual feeding tray 93 is disposed on one side portion of the main body 2 in left and right directions (right in this embodiment). A recording medium P2 of a predetermined size can be fed from the outside through the manual feeding tray 93. The manual feeding tray 93 is an additional tray provided separately from the standard sheet feeding device 4 in the main body 2, and is rotatably attached to the one side portion of the main body 2 to be opened and closed. The recording media P2 on the manual feeding tray 93 are sent to the main conveyance path R0 through a manual feed path R2; one recording media P2 is sent at a time, starting from the uppermost sheet by the driving rotation of a pick-up roller and other elements.

A pair of discharge rollers 91 are disposed further downstream than the fixing unit including the heating roller 59 and the pressure roller 60 in the main conveyance path R0. The pair of discharge rollers 91 drivingly rotate to discharge the printed recording medium P2 onto the collection tray 6.

The image forming apparatus 1 further includes, in the main body 2, a circulation unit 92. The circulation unit 92 reverses a sheet of recording media P having one surface printed for duplex printing. The circulation unit 92 includes a pair of reversing rollers that reverse a sheet of recording media P2 having one surface printed and a plurality of pairs of duplex conveyance rollers. The circulation unit 92 reverses a sheet of recording media P2 having one surface printed and conveys the sheet again to the main conveyance path R0 through a circulation conveyance path R3. Here, the pair of discharge rollers 91 are rotatable back and forth so as to also function as a pair of reversing rollers. Through the back and forth rotation of the pair of discharge rollers 91, the sheet of recording media P can be discharged to outside the image forming apparatus 1 and can be switched (feed in the backward direction) back into the image forming apparatus 1. The circulation conveyance path R3 at its upstream side is branched from the main conveyance path R0 at a portion between the fixing unit of the image forming device 5 and the pair of discharge rollers 91. The circulation conveyance path R3 at its downstream side joins the main conveyance path R0 at a portion further upstream than the transfer unit of the image forming device 5.

The printing operation of the image forming apparatus 1 will be briefly described. The image forming apparatus 1 starts the printing operation upon receiving a start signal, an image signal, or some other signal. When the printing operation starts, the recording medium P2 picked up from the sheet feeder 4 by the feeding mechanism 8 is conveyed along the main conveyance path R0 to the image forming device 5. The image forming device 5 transfers and fixes an image on the recording medium P2 based on color electrophotography. An intermediate transfer method using the intermediate transfer belt 53 is employed as a method of transferring an image onto the recording medium P2.

Processing in the transfer unit of the image forming device 5 will be described. In each of the image forming devices 51 of the respective Y. M, C, and K colors, the surface of the photoreceptor drum 61 charged by the charger 62 is irradiated with laser light from the exposure unit 52. Thus, an electrostatic latent image of a corresponding one of Y, M, C, and K colors is formed on the surface. In the developer 63, the charged toner is transferred onto the surface of the photoreceptor drum 61 having the electrostatic latent image formed. Thus, a toner image is formed on the photoreceptor drum 61. The toner image carried on the surface of the photoreceptor drum 61 is transferred onto the intermediate transfer belt 53 by electrostatic force of the primary transfer roller 54 when the surface comes into contact with the intermediate transfer belt 53. Thus, a toner image with the Y, M, C, and K colors superimposed one on top of each other is formed on the surface of the intermediate transfer belt 53. Un-transferred toner remaining on the photoreceptor drum 61 after the toner image is transferred onto the intermediate transfer belt 53 is scrapped off the photoreceptor drum 61 by the cleaner 64.

The toner image transferred onto the intermediate transfer belt 53 moves to a contact position between the secondary transfer roller 57 and the intermediate transfer belt 53, as the driving roller 55 and the driven roller 56 rotate the intermediate transfer belt 53. Thus, the toner image is transferred onto the recording medium P2 conveyed to the transfer position on the main conveyance path R0. The un-transferred toner remaining on the intermediate transfer belt 53 after the toner image is transferred onto the recording medium P2 is scraped off by the cleaner 58 to be removed from the intermediate transfer belt 53. The recording medium P2, onto which the toner image is transferred at the contact position between the secondary transfer roller 57 and the intermediate transfer belt 53, is conveyed to the fixing unit including the heating roller 59 and the pressure roller 60.

The recording medium P2 loaded with an unfixed toner image on one side is heated and pressed through the fixing position of the fixing unit by the fixing roller 59 and the pressure roller 60. Thus, the unfixed toner image is fixed on the recording medium P2. In the case of the simplex printing, the recording medium P2 after the toner image is fixed (after the simplex printing) is discharged onto the collection tray 6 by the pair of discharge rollers 91. In the case of the duplex printing, the recording medium P2 after the simplex printing is conveyed to the circulation conveyance path R3 for the duplex printing to be reversed and returned to the main conveyance path R0. Thus, a toner image is transferred and fixed on the other side of the recording medium P2 in the image forming device 5, and then the recording medium P2 is discharged onto the collection tray 6.

Image forming apparatuses of the embodiments described below have in common the configuration of the image forming apparatus 1 described above, and are different from each other in the configuration of a sheet feeder and its periphery. Thus, in each of the embodiments described below, the configuration of the sheet feeder and its periphery will be described in detail.

First Embodiment

Figure 4:
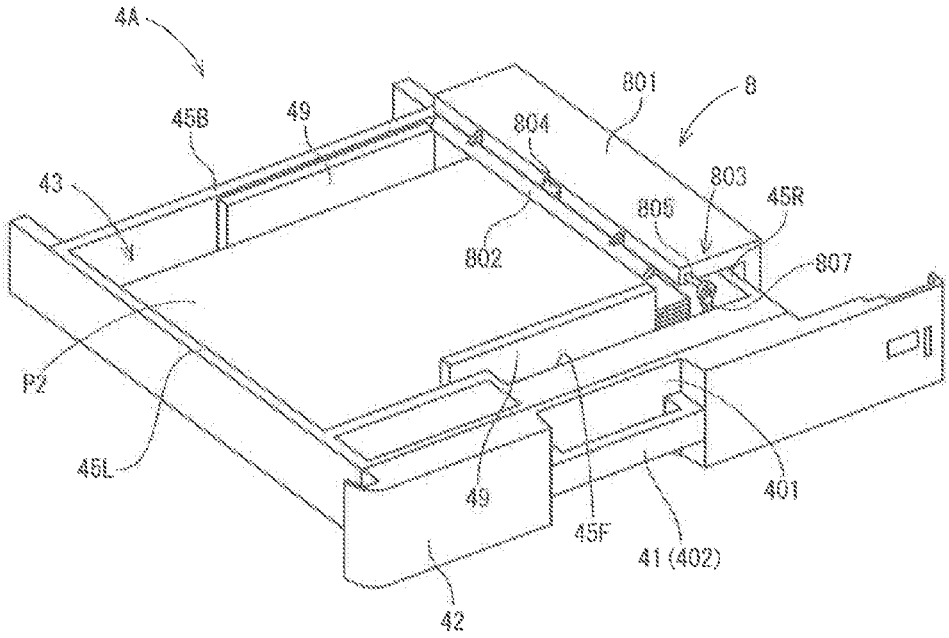
FIG. 4 is a perspective view of a sheet feeder according to a first embodiment.

The configuration of a sheet feeder and its periphery according to the first embodiment is described below by referring to FIG. 4 to FIG. 7. As shown in FIG. 4, a sheet feeder 4A according to the first embodiment includes the recording media storage device 43 and a front cover 42. The recording media storage device 43 has a shape of a box formed by the bottom plate 44 and the surrounding front, back, left, and right side plates 45F, 45B, 45L, and 45R. The front cover 42 is disposed on the front side of the front side plate 45F of the recording media storage device 43.

A recess 401 recessed inward (toward the recording media storage device 43) is formed on the front surface side of the front cover 42. A handle 41 is mounted in the recess 401. The front cover 42 has a hollow box shape. The handle 41 includes a holding portion 402, a base portion 403, and a pair of leg portions 404. The holding portion 402 extends in the left and right direction and is positioned outside the front cover 42. The base portion 403 extends in the left and right direction and is positioned inside the front cover 42. One of the pair of leg portions 404 connects left end portions of the holding portion 402 and the base portion 403, and the other one of the pair of leg portions 404 connects right end portions of the holding portion 402 and the base portion 403. Thus, the handle 41 has a rectangular shape in plan view. The leg portions 404 penetrate through an inner wall in the recess 401. The handle 41 is supported by the inner wall in the recess 401 in such a manner as to be slidable in front and rear directions.

In other words, the handle 41 is able to be handled to slide in an inserting direction and a pulling direction of the recording media storage device 43.

The front cover 42 incorporates a lock member 405 and an interlocking member 406. The lock member 405 disables the recording media storage device 43 to be detached from the main body 2. The interlocking member 406 couples and thus interlocks the handle 41 with the lock member 405. The lock member 405 according to the first embodiment has a pole shape and is movable to protrude outward from the front cover 42 toward the right and to be retracted (slidable in left and right directions). The interlocking member 406 converts the frontward and rearward sliding operation of the handle 41 into the leftward and rightward retracting and protruding operation of the lock member 405. The interlocking member 406 according to the first embodiment includes a pair of upper and lower triangular plates 407 and vertical shafts 408 to 410 each coupling corresponding corner portions of the upper and the lower triangular plates 407. The base portion 403 of the handle 41 is inserted between the upper and the lower triangular plates 407 and between the first vertical shaft 408 on the apex angle side and the second and the third vertical shafts 409 and 410 on the base angle side. The third vertical shaft 410 penetrates through the upper and the lower triangular plates 407. Upper and lower protruding ends of the third vertical shaft 410 are respectively rotatably supported by top and bottom surfaces of the front cover 42. Thus, the interlocking member 406 is able to turn about the third vertical shaft 410.

The interlocking member 406 couples the base end side of the lock member 405 with the first vertical shaft 408. The distal end side of the lock member 405 faces a lock hole 411 formed in the right side plate of the front cover 42. A tension spring 413 as a biasing member is mounted between a longitudinal intermediate portion of the lock member 405 and a fixed portion 412 protruding from the bottom surface of the front cover 42. The tension spring 413 constantly biases the lock member 405 in a direction of making its distal end side protrude outward toward the right through the lock hole 411 of the front cover 42. Thus, when the handle 41 is not handled, the distal end side of the lock member 405 stays in a state of protruding outward toward the right from the front cover 42 through the lock hole 411. An engagement protrusion 22 protruding inwardly toward the left is disposed on a left inner side plate of the main body 2. When the recording media storage device 43 is fully inserted and stored in the main body 2, the distal end side of the lock member 405 engages with the rear surface side of the engagement protrusion 22. Thus, the lock member 405 is set at a locking state in which the recording media storage device 43 disabled to be detached (see FIGS. 6A and 6F).

When pulling out the recording media storage device 43 from the main body 2, an operator holds the holding portion 402 of the handle 41 and pulls the holding portion 402 toward the front (in a direction of pulling out the recording media storage device 43). Thus, the base portion 403 of the handle 41 slides toward the front to press the second vertical shaft 409 of the interlocking member 406 toward the front. Thus, the interlocking member 406 turns about the third vertical shaft 410 in the counter clockwise direction in FIGS. 6A to 6F (see FIG. 6B). This triggers the leftward movement of the first vertical shaft 408 of the interlocking member 406. Thus, the distal end side of the lock member 405 is retracted into the front cover 42 through the lock hole 411 against the elastic biasing force of the tension spring 413. Thus, a free state in which the recording media storage device 43 is detachable is achieved (see FIG. 6B). At this point, the recording media storage device 43 is still inside the main body 2. When the holding portion 402 of the handle 41 is held and further pulled toward the front, the recording media storage device 43 is pulled out to the front of the main body 2 (see FIG. 6C).

Mutually contactable inclined surfaces 221 and 414 are respectively formed on the front surface side of the engagement protrusion 22 and the rear surface side of the distal end of the lock member 405. When the recording media storage device 43 is inserted into the main body 2, the inclined surface 221 of the engagement protrusion 22 comes into contact with the inclined surface 414 of the lock member 405. Thus, the distal end side of the lock member 405 retracts into the front cover 42 through the lock hole 411 against the elastic biasing force of the tension spring 413 (see FIGS. 6D and 6E). When the recording media storage device 43 is fully inserted in the main body 2, the inclined surfaces 221 and 414 are separated from each other. Thus, the distal end side of the lock member 405 protrudes toward the rear surface side of the engagement protrusion 22 by the elastic restoration force of the tension spring 413. As a result, the distal end side of the lock member 405 is engaged with the rear surface side of the engagement protrusion 22. Thus, the locking state in which the recording media storage device 43 is disabled to be detached is achieved (see FIGS. 6A and 6F).

A rearward protruding operation arm 415 is disposed in a longitudinal intermediate portion of the lock member 405. The operation arm 415, which extends in the left and right direction, penetrates through an long hole 416 formed on the rear surface of the front cover 42 and the front side plate 45F of the recording media storage device 43. The operation arm 415 is slidable in left and right directions along the long hole 416 together with the lock member 405. The distal end side of the operation arm 415 is in contact with a rotation piece 807 on a side of the sheet feeder 8 (described in detail later) when the lock member 405 is in the locking (see FIGS. 6A and 6F).

Figure 5:
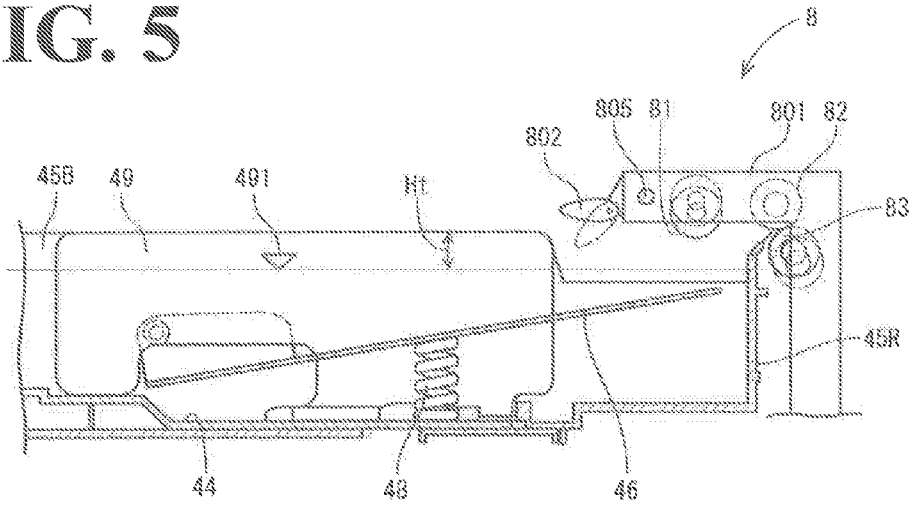
FIG. 5 is an enlarged front cross-sectional view of the sheet feeder and a feeding mechanism, illustrating their relationship.
Figures 6A, 6B, 6C, 6D, 6E, 6F:
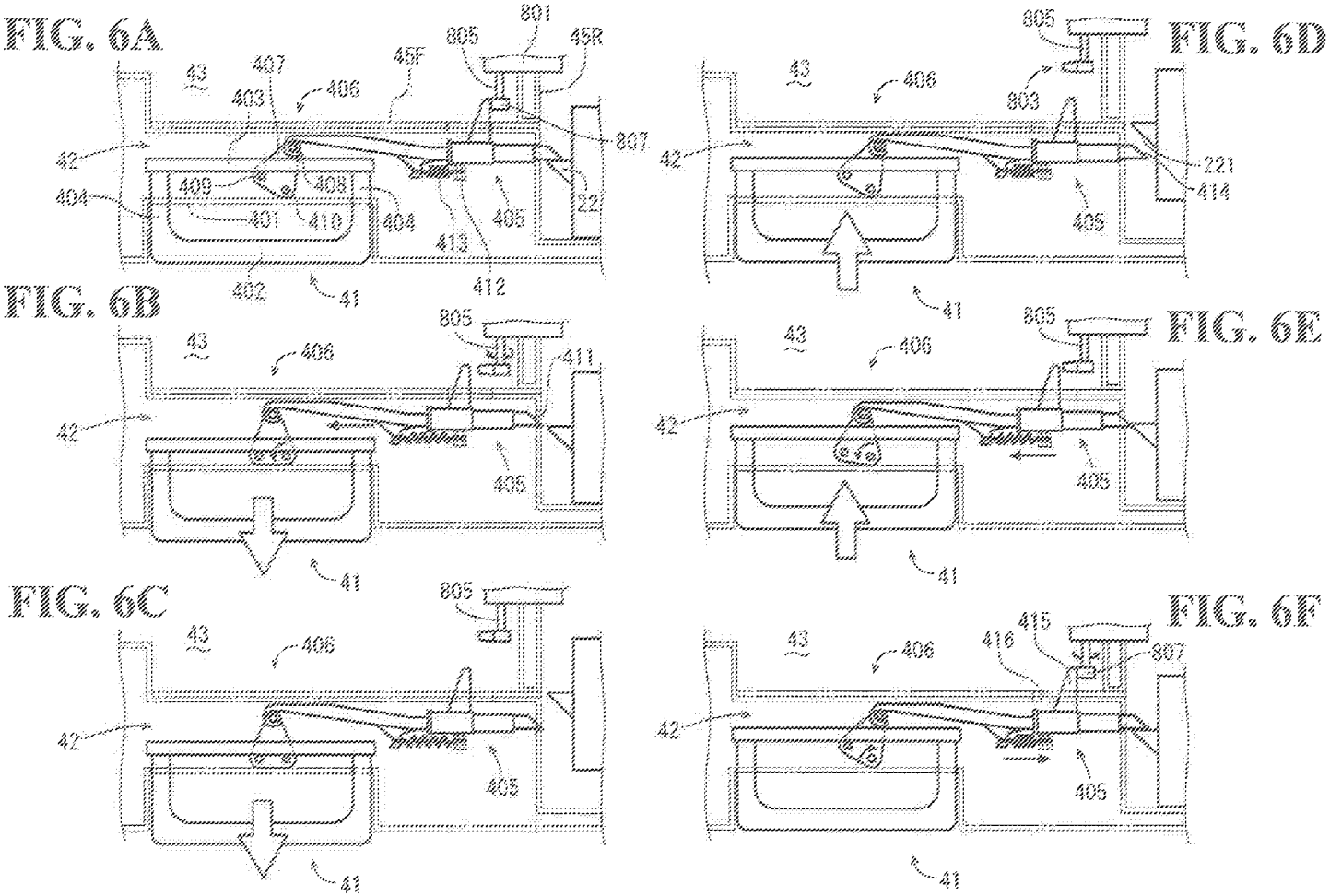
FIGS. 6A to 6F are schematic plan views of a handle and a lock member, illustrating their operation states.

As shown in FIGS. 4 and 5, the feeding mechanism 8 has a base body 801 disposed on a side of the main body 2 and having a shape of a downwardly opened box. The base body 801 according to the first embodiment is disposed to cover the right side plate 45R of the recording media storage device 43. The base body 801 includes an overflow restriction member 802 and a position change mechanism 803. The overflow restriction member 802 is changeable between a restriction position and a withdrawal position. The restriction position (see a position shown by a dotted dashed line in FIG. 5 and FIG. 7B) is closer to the uppermost recording medium P2 in the recording media storage device 43. The withdrawal position (see a position shown by a solid line in FIG. 5 and FIG. 7A) is farther from the uppermost recording medium P2 in the recording media storage device 43. The position change mechanism 803 changes the overflow restriction member 802 into the restriction position when the lock member 405 changes into the free state.

The overflow restriction member 802 extends in the front and rear direction, and has a stick shape (or a plate shape) and an elliptical cross-sectional shape. In the first embodiment, the longitudinal base end side of the overflow restriction member 802 is axially supported by the left side plate of the base body 801. Thus, the overflow restriction member 802 is able to vertically turn about its longitudinal base end side. When the overflow restriction member 802 is turned upward about its longitudinal base end side, the overflow restriction member 802 is set at the withdrawal position (see the position shown by a solid line in FIG. 5 and FIG. 7A farther from the uppermost recording medium P2 in the recording media storage device 43). When the overflow restriction member 802 is turned downward about its longitudinal base end side, the overflow restriction member 802 is set at the restriction position (see a position shown by the dotted dashed line in FIG. 5 and FIG. 7B) closer to the uppermost recording medium P2 in the recording media storage device 43. As described above, the overflow restriction member 802 is able to turn about its longitudinal base end side to change between the restriction position and the withdrawal position.

An outwardly protruding (toward the right) restriction plate 804 is disposed in an intermediate portion of the longitudinal base end side of the overflow restriction member 802. When the overflow restriction member 802 turns downward about its longitudinal base end side, the restriction plate 804 fits in a downward opened notch groove formed in a longitudinal intermediate portion of the left side plate of the base body 801. The restriction plate 804 thus entered the base body 801 further moves to contact a ceiling surface of the base body 801. Thus, the limit of the downward turning of the overflow restriction member 802, that is, the restriction position of the overflow restriction member 802 is determined. As shown in FIG. 5, the distal end position of the overflow restriction member 802 in the restriction position is set to be lower than the upper end position of the sheet width regulating plate 49. In the first embodiment, the distal end position of the overflow restriction member 802 in the restriction position is set to be within a height range Ht. The height range Ht is defined between a storage height limit indication mark 491 formed on an inner surface of the sheet width regulating plate 49 and the upper end position of the sheet width regulating plate 49. The storage height limit indication mark 491 is a mark indicating the highest possible position of a bundle of the recording media P2 stored in the recording media storage device 43.

As shown in FIG. 4, FIG. 5, and FIGS. 7A and 7B, the position change mechanism 803 includes an interlocking shaft 805 extending in parallel to a rotation axis SL1 of the overflow restriction member 802. The interlocking shaft 805 is rotatably supported on the inner side of the base body 801. A pressing piece 806 is secured to the rear end side of the interlocking shaft 805. The pressing piece 806 is able to come into contact with the restriction plate 804 of the overflow restriction member 802 from above. The front end side of the interlocking shaft 805 penetrates through the front side plate of the base body 801 in such a manner that the interlocking shaft 805 is rotatable. The rotation piece 807 is secured to the protruding front end portion of the interlocking shaft 805. The rotation piece 807 is able to come into contact with the operation arm 415 of the lock member 405.

An interlocking spring 808 is fitted on the interlocking shaft 805. The interlocking spring 808 is a torsion spring. The load of the interlocking spring 808 is applied in a coiling direction. Ends of the interlocking spring 808 extend in a tangential direction of the coil. One end of the interlocking spring 808 is in contact with the pressing piece 806 from below. The other end of the interlocking spring 808 is in contact with the inner surface of the left side plate of the base body 801. Thus, the interlocking spring 808 constantly biases the pressing piece 806 in the direction of arrow RR so as to turn upward (to be separated from the restriction plate 804 of the overflow restriction member 802).

When the recording media storage device 43 is fully inserted and stored in the main body 2, and the lock member 405 is set at the locking state, the operation arm 415 of the lock member 405 comes into contact with the rotation piece 807 from the left. Thus, the interlocking shaft 805 is turned in the direction of arrow LR against the elastic biasing force of the interlocking spring 808, and the pressing piece 806 presses the restriction plate 804 from above. As a result, the overflow restriction member 802 turns upward about its longitudinal base end, and thus is set at the withdrawal position (see the state indicated by the solid line in FIG. 5 and FIG. 7A). As described above, the overflow restriction member 802 is switched to the withdrawal position when the recording media storage device 43 is fully inserted and stored in the main body 2.

When the holding portion 402 of the handle 41 is held and pulled toward the front, and thus the lock member 405 changes into the free state, the operation arm 415 of the lock member 405 is separated from the rotation piece 807. Thus, the interlocking shaft 805 is turned in a direction of arrow RR by the elastic restoration force of the interlocking spring 808. Thus, the pressing piece 806 turns upward to be separated from the regulation plate 804. As a result, the overflow restriction member 802 turns downward with its own weight about its longitudinal base end side to be in the restriction position (position shown by the dashed dotted line in FIG. 5 and FIG. 7B). As described above, an operation of pulling the handle 41 toward the front switches the overflow restriction member 802 into the restriction position, before the recording media storage device 43 is pulled out to the front of the main body 2. When the holding portion 402 of the handle 41 is held and further pulled toward the front, the recording media storage device 43 is pulled out to the front of the main body 2 with the overflow restriction member 802 maintained in the restriction position.

As described above, the overflow restriction member 802 is appropriately switchable into the restriction position before the recording media storage device 43 is pulled out to the front of the main body 2. Thus, the uppermost recording medium P2 is able to be reliably prevented from flowing over the recording media storage device 43 to fall and remain in the main body 2 when the recording media storage device 43 is pulled out of the main body 2. Since no electrical component is required for changing the state of the overflow restriction member 802, the sheet feeder with a simple configuration is able to be manufactured at a low cost.

The distal end position of the overflow restriction member 802 in the restriction position is set to be lower than the upper end position of the sheet width regulating plate 49. This ensures that the overflow restriction member 802 does not come into contact with the uppermost recording medium P2 when the recording media storage device 43 is pulled out of the main body 2. Thus, the overflow restriction member 802 will not damage the uppermost recording medium P2, or will not be in the way of the recording media storage device 43 being pulled out. This facilitates the operation of pulling out the recording media storage device 43. Furthermore, the operation of switching the overflow restriction member 802 into the restriction position and the operation of pulling out the recording media storage device 43 are both achieved by the single operation of holding and pulling the handle 41 toward the front. This also facilitates the operation of pulling out the recording media storage device 43.

As described above, the feeding mechanism 8 includes the pick-up rollers 81 and the pairs of separating rollers including the sheet feed rollers 82 and the separation rollers 83. In the first embodiment, the pick-up rollers 81 and the separation rollers 83 of the group of rollers 81 to 83 are switchable between a feeding position to be in contact with the uppermost recording medium P2 in the recording media storage device 43 (see FIG. 7A) and a release position to be separated from the uppermost recording medium P2 (see FIG. 7B). When the lock member 405 changes into the free state, the pick-up rollers 81 and the separation rollers 83 are switched to the release position through the position change mechanism 803.

Here, a pick-up roller shaft 811 having a crank shape and a separation roller shaft 831 similarly having a crank shape are rotatably supported in the base body 801. A rotation axis SL2 of the pick-up roller shaft 811 and a rotation axis SL3 of the separation roller shaft 831 extend in parallel with each other along the rotational axis SL1 of the overflow restriction member 802 and the interlocking shaft 805. The roller shafts 811 and 831 respectively include front and rear rod portions 812 and front and rear rod portions 832, roller support portions 813 and 833, and intermediate portions 814 and 834. The front and rear rod portions 812 and front and rear rod portions 832 each extend coaxially with the corresponding one of the rotation axes SL2 and SL3. The roller support portions 813 and 833 respectively rotatably support the pick-up rollers 81 and the separation rollers 83. The intermediate portions 814 couples the front and rear end portions of the roller supporting portion 813 with the rod portions 812. The intermediate portions 834 couples the front and rear end portions of the roller supporting portion 833 with the rod portions 832.

Figure 7A:
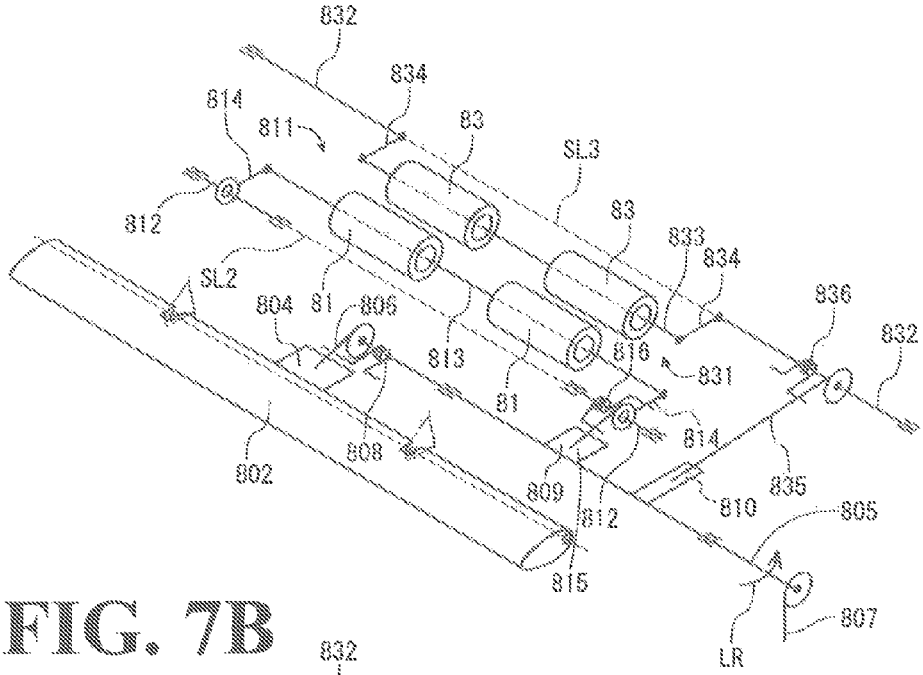
FIGS. 7A and 7B are skeleton diagrams showing a relationship between an overflow restriction mechanism and a position change mechanism in the sheet feeder.
Figure 7B:
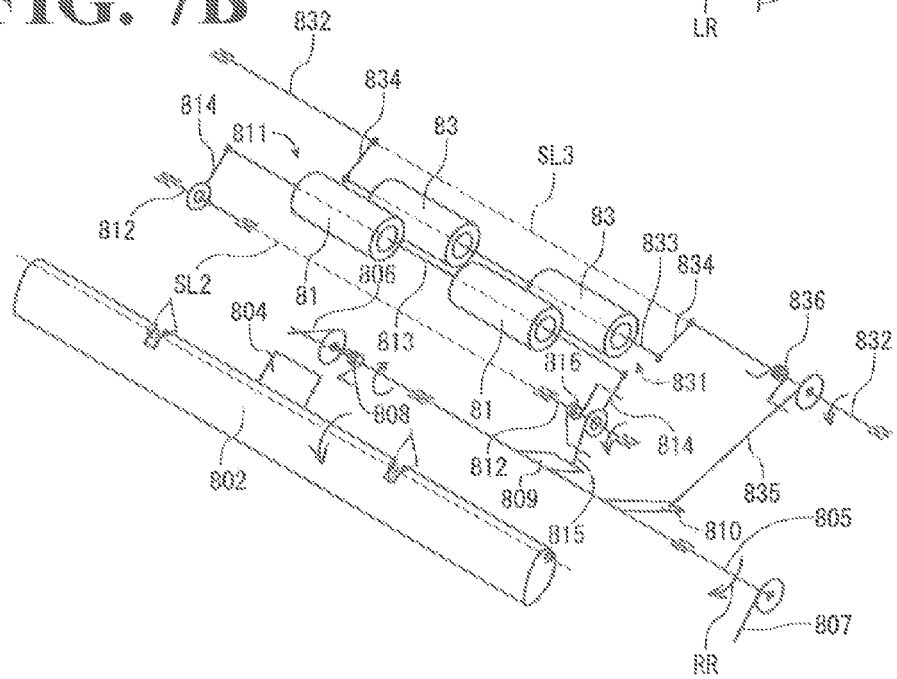

When the pick-up roller shaft 811 is turned upward about the rotational axis SL2, the pick-up rollers 81 are set at the release position (see FIG. 7B). When the pick-up roller shaft 811 is turned downward about the rotational axis SL2, the pick-up rollers 81 are set at the feeding position (see FIG. 7A). When the separation roller shaft 831 turns downward about the rotational axis SL3, the separation rollers 83 are set at the release position (see FIG. 7B). When the separation roller shaft 831 turns upward about the rotational axis SL3, the separation rollers 83 are set at the feeding position (see FIG. 7A).

One end rod portions 812 and 832 of the respective roller shafts 811 and 831 are respectively provided with contact pieces 815 and 835. The contact pieces 815 and 835 protrude in directions opposite to the directions of the intermediate portions 814 and 834. The pick-up contact piece 815 of the pick-up roller shaft 811 is in contact with a pick-up elevation plate 809 disposed in a longitudinal intermediate portion of the interlocking shaft 805 from above. A separation contact piece 835 of the separation roller shaft 831 is in contact with a separation elevation plate 810 from above. The separation elevation plate 810 is disposed at a longitudinal intermediate portion of the interlocking shaft 805 and is parallel to the pick-up elevation plate 809.

Torsion springs 816 and 836 similar to the interlocking spring are respectively fitted on one end rod portions 812 and 832 of the respective roller shafts 811 and 831. One end portion of the pick-up torsion spring 816 on the side of the pick-up roller shaft 811 is in contact with the intermediate portion 814 extending from one end rod portion 812 from below. The other end of the pick-up torsion spring 816 is in contact with the pick-up contact piece 815 from above. One end of the separation torsion spring 836 on the side of the separation roller shaft 831 is in contact with the ceiling surface of the base body 801 from below. The other end of the separation torsion spring 836 is in contact with the separation contact piece 815 from above. Thus, the pick-up torsion spring 816 constantly biases the intermediate portion 814 as well as the pick-up rollers 81 to turn upward, and constantly biases the pick-up contact piece 815 to turn downward. The separation torsion spring 836 constantly biases the separation rollers 83 and the separation contact piece 835 to turn downward.

When the recording media storage device 43 is fully inserted and stored in the main body 2 and thus the lock member 405 is set at the locking state, the operation arm 415 of the lock member 405 is in contact with the rotation piece 807 from the left. Thus, the interlocking shaft 805 turns in the direction of arrow LR against the elastic biasing force of the interlocking spring 808, turning the pick-up elevation plate 809 and the separation elevation plate 810 upward. This turns the pick-up contact piece 815 upward against the elastic biasing force of the pick-up torsion spring 816 and turns the pick-up rollers 81 downward. Thus, the feeding position is achieved (see FIG. 7A). Furthermore, when the separation contact piece 835 turns upward against the elastic biasing force of the separation torsion spring 836, the separation rollers 83 turn upward. Thus, the feeding position is achieved (FIG. 7A). As described above, when the recording media storage device 43 is fully inserted and stored in the main body 2, the overflow restriction member 802 is switched to the withdrawal position and the pick-up rollers 81 and the separation rollers 83 are switched to the release position.

When the holding portion 402 of the handle 41 is held and pulled toward the front and thus the lock member 405 changes into the free state, the operation arm 415 of the lock member 405 is separated from the rotation piece 807. Thus, the interlocking shaft 805 is turned in the direction of arrow RR by the elastic restoration force of the interlocking spring 808, and thus the pick-up elevation plate 809 and the separation elevation plate 810 turn downward (released). Then, the pick-up contact piece 815 is turned downward by the elastic restoration force of the pick-up torsion spring 816, and the pick-up rollers 81 turn upward to be in the release position (see FIG. 7B). When the separation contact piece 835 is turned downward by the elastic restoration force of the separation torsion spring 836, the separation rollers 83 turn downward to be in the release position (see FIG. 7B). As described above, the operation of pulling the handle 41 toward the front switches the overflow restriction member 802 into the restriction position and switches the pick-up rollers 81 and the separation rollers 83 to the release position, before the recording media storage device 43 is pulled out to the front of the main body 2. It is a matter of course that when the holding portion 402 of the handle 41 is held and further pulled toward the front, the recording media storage device 43 is pulled out in front of the main body 2 while the overflow restriction member 802 stays in the restriction position and the pick-up rollers 81 and the separation rollers 83 stay in the release position.

Thus, not only the overflow restriction member 802 is appropriately switched into the restriction position, but also the pick-up rollers 81 and the separation rollers 83 are switched to the release position through the position change mechanism 803, before the recording media storage device 43 is pulled out of the main body 2 toward the front. This eliminates or minimizes the contact resistance between the pick-up rollers 81 and the separation rollers 83 and the uppermost recording medium P2. This, in turn, more reliably prevents the remaining of a sheet, and further facilitates the operation of pulling out the recording media storage device 43.

Second Embodiment

Next, the configuration of a sheet feeder and its periphery according to a second embodiment will be described by referring to FIGS. 8 to 11. In this and later embodiments, components having the same configurations and functions as the counterparts according to the first embodiment are denoted with the same reference numerals and will not be elaborated here. As shown in FIGS. 8 to 11, in a sheet feeder 4B of the second embodiment, the front cover 42 disposed in front of the front side plate 45F of the recording media storage device 43 is slidable toward the front and the rear of the recording media storage device 43.

The front cover 42 includes a front plate 421, a slide 422, a positioning pin 423, the lock members 405, an operation block 424, and biasing members 425. The front plate 421 covers the front side of the front side plate 45F of the recording media storage device 43. The slide 422 is slidably fitted to the bottom plate 44 and the side plates 45L and 45R of the recording media storage device 43. The positioning pin 423 determines the slidable range of the front cover 42 with respect to the recording media storage device 43. The lock member 405 is unengaged from the main body 2 in accordance with the operation of pulling the handle 41 toward the front. The operation block 424 is able to come into contact with the rotation piece 807 on a side of the feeding mechanism 8 when the lock members 405 are in the locking state. The biasing members 425 are each a spring material or a similar material. The biasing member 425 biases the recording media storage device 43 toward the rear.

The slide 422 of the front cover 42 has a square U shaped cross-section, and projects toward the rear from the rear surface of the front plate 421. The inner side of the slide 422 is in slidable contact with the outer sides of the bottom plates 44 and the left and the right side plates 45L and 45R. The positioning pin 423 protrudes upward from an upper surface of a bottom plate portion of the slide 422, which is in slidable contact with the bottom plate 44. The biasing members 425 are disposed in an area of a rear surface of the front plate 421 surrounded by the slide 422. The operation block 424 and the lock members 405 are disposed on left and right outer sides of the slide 422 in the rear surface of the front pate 421. In the second embodiment, the lock members 405 are disposed on both sides of the slide 422, and the operation block 424 is disposed only at a position facing the feeding mechanism 8.

The recording media storage device 43 has, in the bottom plate 44, a positioning groove 431. The positioning pin 423 disposed on the slide 422 of the front cover 42 is inserted into the positioning groove 431 having a shape of a hole extending in the front and rear direction. The positioning pin 423 is inserted in the positioning groove 431, and thus the movement range of the positioning pin 423 is determined by the longitudinal length of the positioning groove 431. Thus, the position of the front cover 42 is determined by a relative relationship between the positioning pin 423 and the positioning groove 431. In other words, the front cover 42 slides independently from the recording media storage device 43 within a range determined by the length of the positioning groove 431 in the front and rear direction.

Although not elaborated in the drawings, a sensor detects a contact position between the uppermost recording medium P2 placed on the elevation plate 46 and the sheet feed rollers 82. A motor is driven in accordance with a detection result of the sensor. Thus, the elevation amount of the elevation plate 46 is adjusted. Contact pressures from the pick-up rollers 81 and the sheet feed rollers 82 to the recording medium P2 are maintained at a constant level by thus adjusting the elevation amount of the elevation plate 46.

A switching inclined surface 427 is formed on a distal end side (rear end side) of the operation block 424. The switching inclined surface 427 comes into pressure contact with the rotation piece 807 from the left to turn the interlocking shaft 805 in the direction of arrow LR. When the front cover 42 is pushed toward the rear so that the recording media storage device 43 is inserted in the main body 2, the switching inclined surface 427 of the operation block 424 comes into contact with the rotation piece 807 from the left. Thus, the interlocking shaft 805 is turned in the direction of arrow LR against the elastic biasing force of the interlocking spring 808. As a result, the overflow restriction member 802 turns upward about its longitudinal base end side to be in the withdrawal position as in the first embodiment (see FIG. 8). As described above, also in the second embodiment, the overflow restriction member 802 switches to the withdrawal position when the recording media storage device 43 is fully inserted and stored in the main body 2.

The operation of pulling the handle 41 toward the front disengages the lock member 405 from the engagement protrusion 22, and the front cover 42 slides toward the front. Thus, the switching inclined surface 427 of the operation block 424 is separated from the rotation piece 807, and the interlocking shaft 805 is drivingly rotated in the direction of arrow RR by the elastic restoration force of the interlocking spring 808. As a result, the overflow restriction member 802 turns downward with its own weight about its longitudinal base end side to be in the restriction position (see FIGS. 9 to 11). As described above, the operation of pulling the handle 41 toward the front switches the overflow restriction member 802 into the restriction position before the recording media storage device 43 is pulled out to the front of the main body 2. When the holding portion 402 of the handle 41 is held and further pulled toward the front, the recording media storage device 43 is pulled out to the front of the main body 2 along with the front cover 42. During the operation, the overflow restriction member 802 stays in the restriction position.

Figure 8:
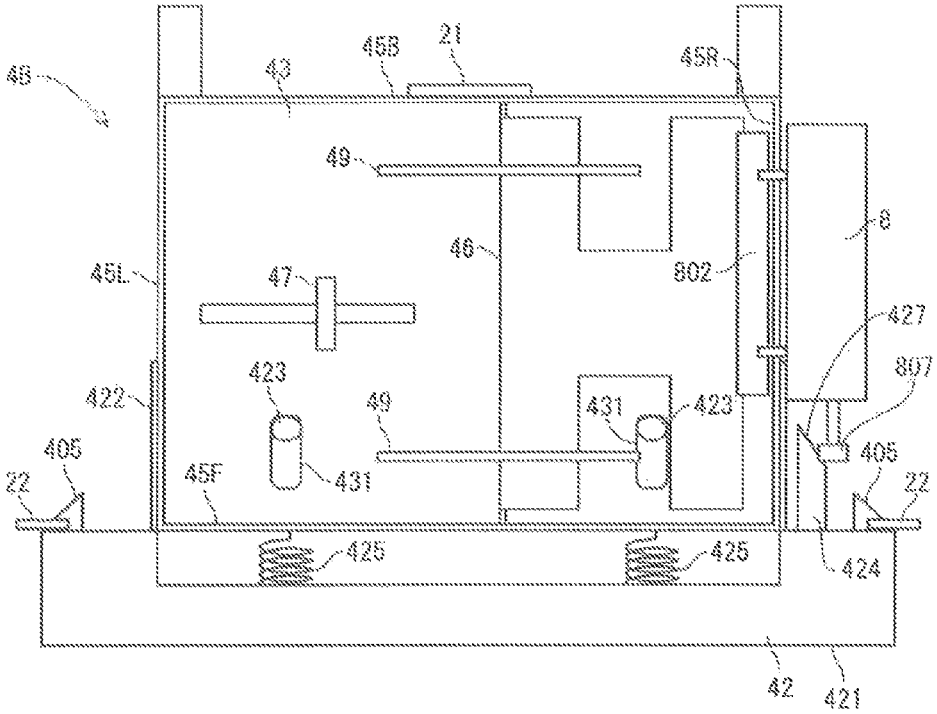
FIG. 8 is a plan view of a sheet feeder according to a second embodiment stored in a main body.

As shown in FIG. 8, when the sheet feeder 4B is stored in the main body 2, the back side plate 45B of the recording media storage device 43 is in contact with the positioning member 21 disposed in the main body 2. Thus, the rearward movement of the recording media storage device 43 is restricted. The lock member 405 of the front cover 42 engages with the engagement protrusion 22 disposed in the main body 2. Thus, the forward movement of the front cover 42 is restricted. With the forward movement of the front cover 42 being thus restricted, the recording media storage device 43 is biased toward the rear by the biasing member 425. As a result, the recording media storage device 43 in contact with the positing member 21 is disposed at a predetermined position in the main body 2.

Figure 9:
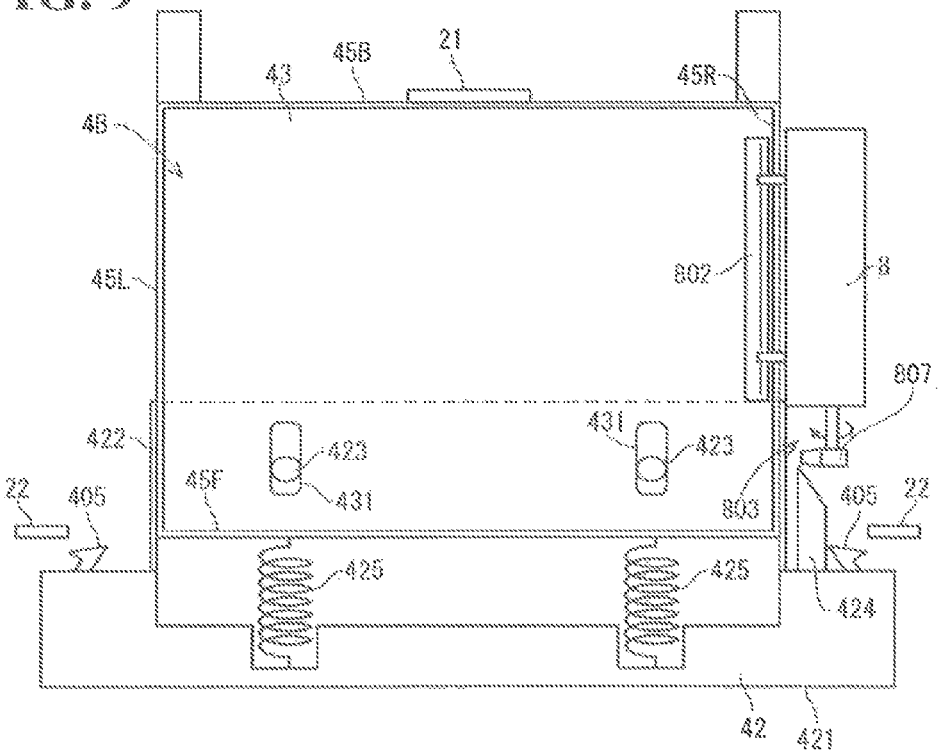
FIG. 9 is a schematic view showing a state in which only a front cover has slid.

To pull out the sheet feeder 4B in the main body 2, the handle 41 is pulled toward the front so that the lock member 405 is disengaged from the engagement protrusion 22. When the handle 41 is held and pulled toward the front, the front cover 42 slides toward the front. Here, as shown in FIG. 9, the biasing member 425 of the front cover 42 biases the recording media storage device 43 toward the rear. Thus, the frontward movement of the recording media storage device 43 is restricted. The operation block 424 attached to the front cover 42 moves toward the front along with the front cover 42 to be separated from the rotation piece 807. As a result, the pick-up rollers 81 and the separation rollers 83 are separated respectively from the recording medium P2 and the sheet feed rollers 82, and the pressure contact of the feeding mechanism 8 is released. At the same time, the overflow restriction member 802 switches into the restriction position.

Figure 10:
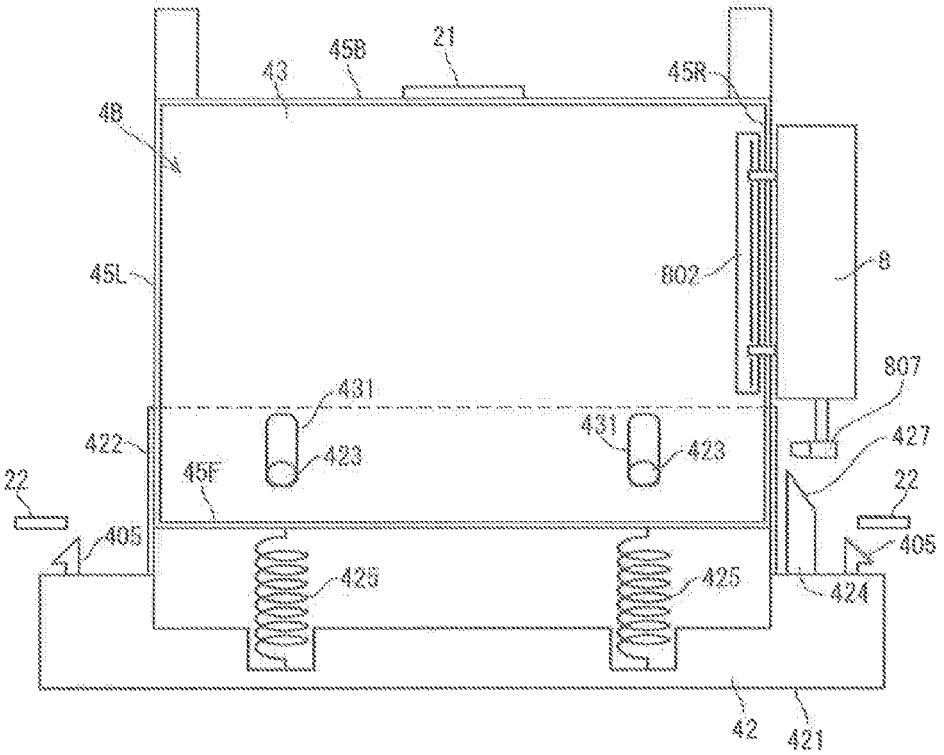
FIG. 10 is a schematic view of a state in which the front cover and the recording media storage device are integrated.
Figure 11:
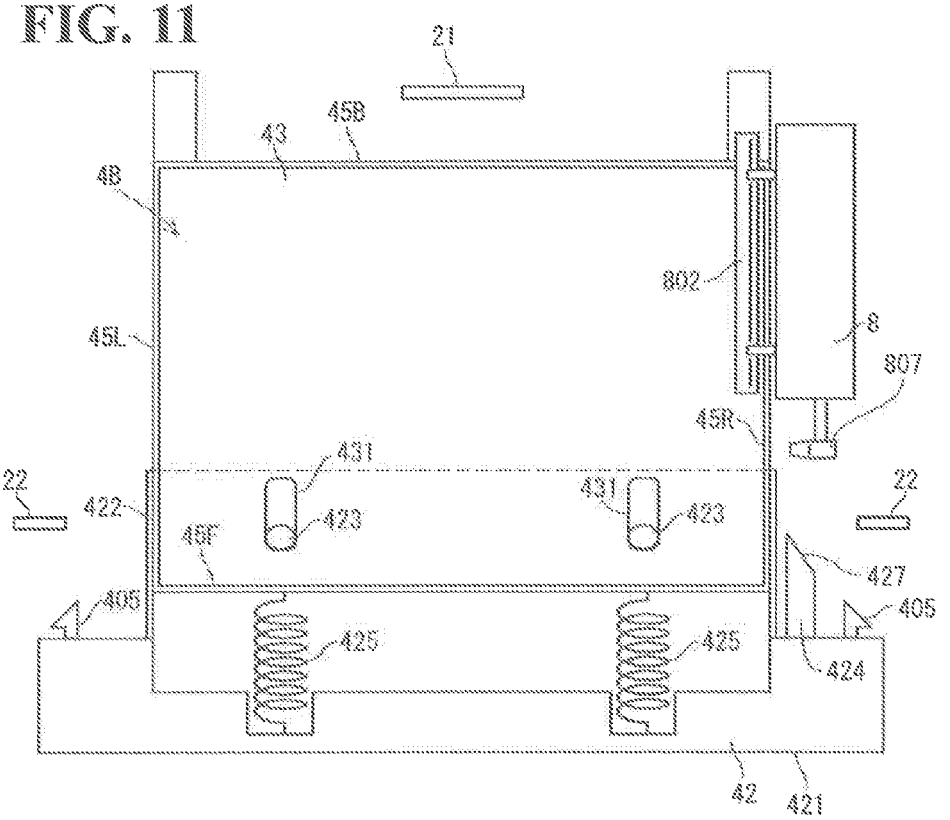
FIG. 11 is a schematic view showing a state in which the front cover slides along with the recording media storage device.

As shown in FIG. 10, the frontward movement of the front cover 42 from the recoding medium storage device 43 is restricted when the positioning pin 423 of the front cover 42 sliding toward the front comes into contact with the front side of the positioning groove 431. When the positioning pin 423 comes into contact with the front side of the positioning groove 431, the recoding medium storage device 43 is engaged with the front cover 42. Thus, when the front cover 42 is further pulled toward the front, the recoding medium storage device 43 slides along with the front cover 42 as shown in FIG. 11.

As described above, to pull out the sheet feeder 4B from the main body 2, first, the operation block 424 is pulled out to the front along with the front cover 42 with the movement of the recording media storage device 43 restricted. Thus, the pressure contact of the pick-up rollers 81 and the separation rollers 83 of the feeding mechanism 8 is completely released, and the overflow restriction member 802 switches into the restriction position. Then, the recoding medium storage device 43 is pulled out to the front along with the front cover 42. This prevents the recording medium P2 from being damaged or falling into the main body 2. As shown in FIG. 8, the movable length of the positioning pin 423 in the positioning groove 431 is longer than the length of an overlapping area between the operation block 424 and the feeding mechanism 8. With this configuration, when the sheet feeder 4B is pulled out, the movement of the recording media storage device 43 is restricted until the overflow restriction member 802 is switched into the restriction position.

When the sheet feeder 4B inserted and stored into the main body 2, the front cover 42 is pushed toward the rear without the need for handling the handle 41, as opposed to the case where the sheet feeder 4B is pulled out of the main body 2. Here, the biasing member 425 of the front cover 42 applies the biasing force toward the rear to the recording media storage device 43. Thus, as shown in FIG. 11, the recording media storage device 43 moves rearward along with the front cover 42 to be stored in the main body 2. Then, as shown in FIG. 10, when the back side plate 45B of the recording media storage device 43 comes into contact with the positioning member 21, the rearward movement of the recording media storage device 43 is restricted. Thus, only the front cover 42 is further inserted toward the rear.

As shown in FIG. 9, when the front cover 42 is further inserted toward the rear, only the front cover 42 moves toward the rear until the operation block 424 attached to the front cover 42 comes into pressure contact with the rotation piece 807 from the left. As a result, the pick-up rollers 81 and the separation rollers 83 respectively come into pressure contact with the recording medium P2 and the sheet feed rollers 82. Furthermore, the overflow restriction member 802 switches to the withdrawal position. When the front cover 42 is further inserted, the lock member 405 of the front cover 42 engages with the engagement protrusion 22 of the main body 2 as shown in FIG. 8. Thus, the sheet feeder 4B is unmovably stored in the main body 2.

As described above, when inserting the sheet feeder 4B into the main body 2, first, the recording media storage device 43 is positioned at the predetermined position in the main body 2, and then the operation block 424 is further inserted toward the rear along with the front cover 42. Thus, the pick-up rollers 81 and the separation rollers 83 come into pressure contact with target objects and the overflow restriction member 802 is switched to the withdrawal position. In other words, when inserting the sheet feeder 4B, the pressure contact of the feeding mechanism 8 to the recording medium P2 and the switching of the overflow restriction member 802 to the withdrawal position are restricted until the recording media storage device 43 is positioned at the predetermined position. Thus, the pick-up rollers 81 and the separation rollers 83 come into pressure contact, and the overflow restriction member 802 is switched to the withdrawal position after the recording medium P2 is set at the predetermined position. This prevents the recording medium P2 from being slacked or damaged.

Third Embodiment

Figure 12:
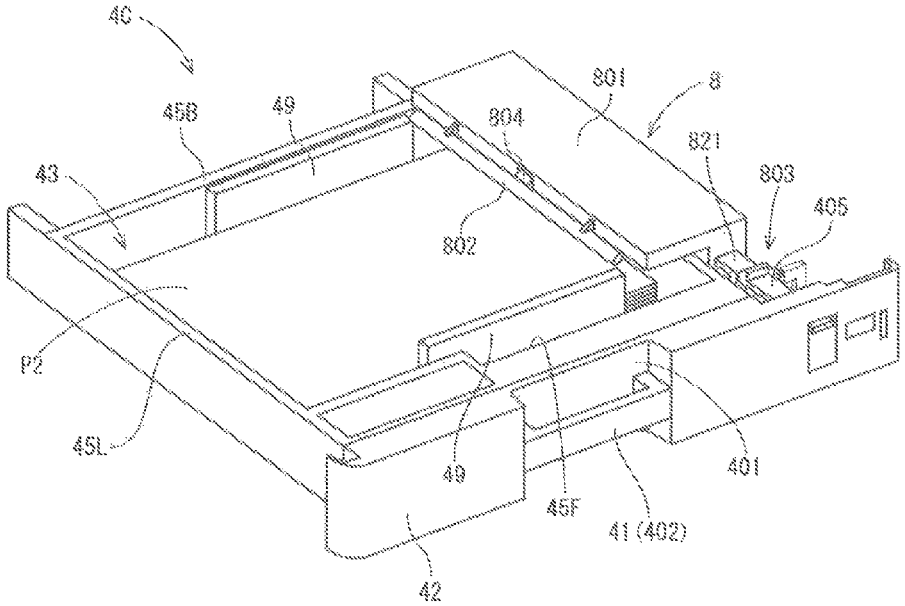
FIG. 12 is a perspective view of a sheet feeder according to a third embodiment.
Figure 13A:
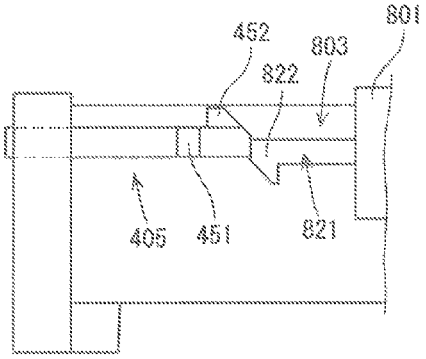
FIGS. 13A and 13B are side views of a lock member and a lever body, illustrating their relationship.
Figure 13B:
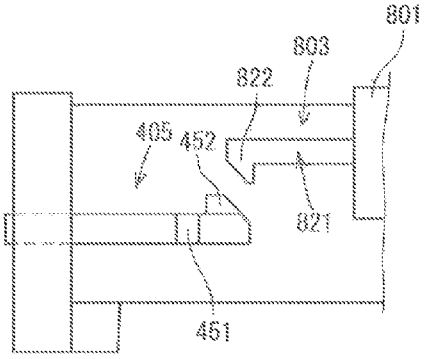

Next, the configuration of a sheet feeder and its periphery according to the third embodiment will be described with reference to FIGS. 12, 13A, and 13B. In a sheet feeder 4C of the third embodiment, the lock member 405 as a vertically operable lever is disposed on the front cover 42 disposed in front of the front side plate 45F of the recording media storage device 43. A front end side of the lock member 405 protrudes toward the front surface side of the front cover 42. A rightward hook 451 and an upward hook 452 for locking are formed on the rear end side of the lock member 405. When the front end side of the lock member 405 is held and operated upward while the recording media storage device 43 is fully inserted and stored in the main body 2, the rightward hook 451 of the lock member 405 engages with the engagement protrusion 22 formed on the left inner side plate of the main body 2. Thus, the locking state in which the recording media storage device 43 is not detachable is achieved. When the front end side of the lock member 405 is held and operated downward, the rightward hook 451 of the lock member 405 is disengaged from the engagement protrusion 22 of the main body 2. Thus, the state in which the recording media storage device 43 is detachable is achieved.

The position change mechanism 803 disposed in the base body 801 includes a lever body 821 protruding forward from the front side plate of the base body 801. The lever body 821 is slidable in front and rear directions. The front or rear sliding movement of the lever body 821 is converted into the upward or downward driving rotation of the overflow restriction member 802 about its longitudinal base end side. A downward hook 822 capable of coming into contact with the upward hook 452 of the lock member 405 is formed on the front end side of the lever body 821.

When the front end side of the lock member 405 is held and operated upward while the recording media storage device 43 is fully inserted and stored in the main body 2, the upward hook 452 of the lock member 405 is in contact with the downward hook 822 of the lever body 821 from below. Thus, the lever body 821 slides toward the rear against the elastic biasing force of a spring and the like. As a result, the overflow restriction member 802 turns upward about its longitudinal base end side to be in the withdrawal position. Thus, the overflow restriction member 802 is switched to the withdrawal position when the lock member 405 is set at the locking state. When the front end side of the lock member 405 is held and operated downward while the recording media storage device 43 is fully inserted and stored in the main body 2, the upward hook 452 of the lock member 405 is separated from the downward hook 822 of the lever body 821. Thus, the lever body 821 is slid toward the front by the elastic restoration force of a spring or a similar element. As a result, the overflow restriction member 802 turns downward with its own weight about its longitudinal base end side to be in the restriction position. Thus, the overflow restriction member 802 switches to the restriction state before the recording media storage device 43 is pulled out to the front of the main body 2 when the lock member 405 changes into the free state.

The configuration of the feeding mechanism 8 in each of the embodiments shows an example of a mechanism for changing the positions of the overflow restriction member 802, the pick-up rollers 81, and the separation rollers 83. Thus, the configuration of the feeding mechanism 8 is not limited to the configurations recited in the embodiments. Any other configuration may be employed insofar as the positions of the overflow restriction member 802, the pick-up rollers 81, and the separation rollers 83 are appropriately switched.

While an electrophotographic image forming apparatus has been described as an example of the image forming apparatus of the present invention, this should not be construed in a limiting sense. The image forming apparatus of the present invention may be any type of image forming apparatus including the sheet feeder and the feeding mechanism. Possible examples other than the electrophotographic image forming apparatus include an ink-jet image forming apparatus. Furthermore, an image forming apparatus of the present invention may be any of a printer, a copier, a fax machine, and a multi-function machine (MFP) integrally incorporating copy, scanner, printer, and fax capabilities, insofar as the sheet feeder and the feeding mechanism in any of the embodiments are included. Moreover, the location or arrangement of individual elements in the illustrated embodiments should not be construed in a limiting sense. Various modifications can be made without departing from the scope of the present invention.

Obviously, numerous modifications and variations of the present disclosure are possible in light of the above teachings. It is therefore to be understood that within the scope of the appended claims, the present disclosure may be practiced otherwise than as specifically described herein.

What is claimed as new and desired to be secured by Letters Patent of the United States is:

1. A sheet feeder comprising:

a recording media storage device configured to store recording media, the recording media storage device being attachable to and detachable from a main body of an image forming apparatus, the image forming apparatus comprising a feeding mechanism configured to pick up and convey one of the recording media stored in the recording media storage device at a time;

a lock member configured to disable the recording media storage device to be detached;

an overflow restriction member disposed in the main body and configured to change between a restriction position closer to an uppermost part of the recording media in the recording media storage device and a withdrawal position farther from the uppermost part of the recording media; and a position change mechanism disposed in the main body and configured to change the overflow restriction member into the restriction position when the lock member changes into a free state in which the recording media storage device is attachable and detachable.

2. The sheet feeder according to claim 1, further comprising a side regulation member disposed in the recording media storage device and configured to regulate a width direction position of the recording media in the recording media storage device, wherein a distal end position of the overflow restriction member in the restriction position is lower than an upper end position of the side regulation member.

3. The sheet feeder according to claim 2, wherein a feeding mechanism is configured to change a feeding position in contact with the uppermost part of the recording media and a release position separated from the uppermost part of the recording media, and wherein the feeding mechanism is configured to change into the release position through the position change mechanism when the lock member changes into the free state.

4. The sheet feeder according to claim 2, further comprising a handle disposed on a front surface side of the recording media storage device so as to operate the lock member, wherein the handle is operable to move in an inserting direction and a pulling direction of the recording media storage device, and wherein the handle is operable to move in the pulling direction of the recording media storage device so as to change the lock member into the free state.

5. The sheet feeder according to claim 2, further comprising a front cover disposed on a front side of the recording media storage device, wherein the front cover has a section in which the front cover is independently slidable in an inserting direction and a pulling direction of the recording media storage device relative to the recording media storage device, and wherein the front cover is operable to independently slide in the pulling direction of the recording media storage device within the section so as to change the lock member into the free state.

6. The sheet feeder according to claim 3, further comprising a handle disposed on a front surface side of the recording media storage device so as to operate the lock member, wherein the handle is operable to move in an inserting direction and a pulling direction of the recording media storage device, and wherein the handle is operable to move in the pulling direction of the recording media storage device so as to change the lock member into the free state.

7. The sheet feeder according to claim 3, further comprising a front cover disposed on a front side of the recording media storage device, wherein the front cover has a section in which the front cover is independently slidable in an inserting direction and a pulling direction of the recording media storage device relative to the recording media storage device, and wherein the front cover is operable to independently slide in the pulling direction of the recording media storage device within the section so as to change the lock member into the free state.

8. The sheet feeder according to claim 6, further comprising a front cover disposed on a front side of the recording media storage device, wherein the front cover has a section in which the front cover is independently slidable in an inserting direction and a pulling direction of the recording media storage device relative to the recording media storage device, and wherein the front cover is operable to independently slide in the pulling direction of the recording media storage device within the section so as to change the lock member into the free state.

9. An image forming apparatus comprising:

a recording media storage device configured to store recording media;

a feeding mechanism configured to pick up and convey one of the recording media stored in the recording media storage device at a time;

a lock member configured to switch the recording media storage device between a state in which the recording media storage device is not detachable and a state in which the recording media storage device is attachable and detachable;

an overflow restriction member configured to change between a restriction position closer to an uppermost part of the recording media in the recording media storage device and a withdrawal position farther from the uppermost part of the recording media; and a position change mechanism configured to change the overflow restriction member into the restriction position when the lock member changes into a free state in which the recording media storage device is attachable and detachable.

10. The image forming apparatus according to claim 9, further comprising a side regulation member disposed in the recording media storage device and configured to regulate a width direction position of the recording media in the recording media storage device, wherein a distal end position of the overflow restriction member in the restriction position is lower than an upper end position of the side regulation member.

11. The image forming apparatus according to claim 10, further comprising a handle disposed on a front surface side of the recording media storage device so as to operate the lock member, wherein the handle is operable to move in an inserting direction and a pulling direction of the recording media storage device, and wherein the handle is operable to move in the pulling direction of the recording media storage device so as to change the lock member into the free state.

12. The image forming apparatus according to claim 10, further comprising a front cover disposed on a front side of the recording media storage device, wherein the front cover has a section in which the front cover is independently slidable in an inserting direction and a pulling direction of the recording media storage device relative to the recording media storage device, and wherein the front cover is operable to independently slide in the pulling direction of the recording media storage device within the section so as to change the lock member into the free state.

13. The image forming apparatus according to claim 9, wherein the feeding mechanism is configured to change between a feeding position in contact with the uppermost part of the recording media and a release position separated from the uppermost part of the recording media, and wherein the feeding mechanism is configured to change into the release position through the position change mechanism when the lock member changes into the free state.

14. The image forming apparatus according to claim 13, further comprising a handle disposed on a front surface side of the recording media storage device so as to operate the lock member, wherein the handle is operable to move in an inserting direction and a pulling direction of the recording media storage device, and wherein the handle is operable to move in the pulling direction of the recording media storage device so as to change the lock member into the free state.

15. The image forming apparatus according to claim 13, further comprising a front cover disposed on a front side of the recording media storage device, wherein the front cover has a section in which the front cover is independently slidable in an inserting direction and a pulling direction of the recording media storage device relative to the recording media storage device, and wherein the front cover is operable to independently slide in the pulling direction of the recording media storage device within the section so as to change the lock member into the free state.

* * * * *